US008967618B2

(12) United States Patent
Sakakibara

(10) Patent No.: US 8,967,618 B2
(45) Date of Patent: Mar. 3, 2015

(54) SHEET TRANSPORT DEVICE

(71) Applicant: Arisa Sakakibara, Nagoya (JP)

(72) Inventor: Arisa Sakakibara, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 14/038,802

(22) Filed: Sep. 27, 2013

(65) Prior Publication Data

US 2014/0167352 A1 Jun. 19, 2014

(30) Foreign Application Priority Data

Dec. 14, 2012 (JP) ..... 2012-273466

(51) Int. Cl.
*B65H 5/06* (2006.01)
*B65H 9/04* (2006.01)

(52) U.S. Cl.
CPC . *B65H 5/062* (2013.01); *B65H 9/04* (2013.01)
USPC ..... 271/272; 271/264; 271/10.11

(58) Field of Classification Search
CPC ..... B65H 5/062; B65H 5/06; B65H 5/064
USPC ..... 271/264, 272–274, 314; 399/124; 358/498
See application file for complete search history.

(56) References Cited

U.S. PATENT DOCUMENTS

| | | | |
|---|---|---|---|
| 7,429,039 | B2 | 9/2008 | Hattori et al. |
| 2006/0085946 | A1 | 4/2006 | Hattori et al. |
| 2011/0242623 | A1 | 10/2011 | Akimatsu |

FOREIGN PATENT DOCUMENTS

| | | | |
|---|---|---|---|
| JP | H11-106082 | A | 4/1999 |
| JP | 2006-118613 | A | 5/2006 |
| JP | 2011-211480 | A | 10/2011 |

*Primary Examiner* — Luis A Gonzalez
(74) *Attorney, Agent, or Firm* — Banner & Witcoff, Ltd.

(57) ABSTRACT

A sheet transport device includes a transport roller which transports a sheet, a cover which covers the transport roller, a pinch roller attached to the cover via a shaft facing the transport roller, and a regulation member projecting from a facing surface, facing the transport roller, of the cover and configured to regulate a movement of the shaft in an extending direction of the shaft. The regulation member includes a surface which extends along the extending direction of the shaft, a first end portion fixed to the cover, and a second end portion which faces an end face of the shaft, and is located closer to the end face of the shaft than the first end portion in the extending direction of the shaft.

8 Claims, 13 Drawing Sheets

SHEET TRANSPORT DEVICE

CROSS-REFERENCE TO RELATED APPLICATION

This application claims priority from Japanese Patent Application No. 2012-273466, filed on Dec. 14, 2012, the entire subject matter of which is incorporated herein by reference.

TECHNICAL FIELD

Aspects of the present invention relate to a sheet transport device which reads an image on a sheet while transporting the sheet along a predetermined transport path.

BACKGROUND

There has been known a sheet transport device configured to read an image on a sheet using a reading unit while transporting the sheet along a predetermined transport path (for example, refer to JP-A-2011-211480).

The sheet transport device disclosed in JP-A-2011-211480 includes a U-turn transport path disposed in a middle portion of the transport path from a sheet feed side to a sheet discharge side. The sheet transport device includes, in the U-turn transport path, a main roller which transports and guides the sheet to U-turn the sheet, and a pinch roller which is arranged to face an upper portion of the main roller during the transport of the sheet and transports the sheet together with the main roller.

The sheet transport device further includes a cover member which covers the main roller from above and opens at least a portion of the transport path from above when maintenance is performed or jamming occurs. The pinch roller is supported by a rear surface of the cover member. Also, a shaft of the pinch roller does not necessarily have to receive driving since only the pinch roller is rotated by the driving of the main roller. Therefore, the shaft of the pinch roller is fixed to the rear surface of the cover member by, for example, fitting using the elastic deformation of a rib formed on the rear surface of the cover member.

This kind of sheet transport device is demanded to be made thinner and the cover member is demanded to be made thinner. Accordingly, the height of the rib which supports the shaft of the pinch roller is required to be reduced.

However, this type of rib is integrally formed on the rear surface of the cover member by resin forming, and thus it is difficult to reduce the height of the rib without limitation to make the cover member thin. In other words, as described above, the shaft of the pinch roller is fixed by using the elastic deformation of the rib, and the amount of elastic deformation becomes insufficient when the height of the rib is excessively reduced and the operation becomes difficult when the shaft is attached. Also, in some cases, there is a possibility that the rib wound be damaged.

SUMMARY

Accordingly, an aspect of the present invention provides a sheet transport device in which a cover can be made thinner while a shaft of a pinch roller can be easily attached to the cover.

According to an illustrative embodiment of the present invention, there is provided a sheet transport device including a transport roller configured to transport a sheet, a cover configured to cover the transport roller, a pinch roller attached to the cover via a shaft facing the transport roller, and configured to transport the sheet in cooperation with the transport roller, and a regulation member projecting from a facing surface, facing the transport roller, of the cover in a first direction which points toward the transport roller, and configured to regulate a movement of the shaft in a direction along an extending direction of the shaft. The regulation member includes a surface which extends along a second direction which is the extending direction of the shaft, a first end portion which is fixed to the facing surface, and a second end portion which faces an end face of the shaft and is located closer to the end face of the shaft than the first end portion in the second direction.

According to the above sheet transport device, the height of the regulation member can be reduced while making the cover thinner, and the amount of elastic deformation (amount of deflection) of the regulation member can be easily ensured and the attachment operation can be easily performed when the pinch roller is attached to the cover. After the attachment of the pinch roller, the movement of the pinch roller along the axial direction with respect to the cover can be regulated.

BRIEF DESCRIPTION OF THE DRAWINGS

The above and other aspects of the present invention will become more apparent and more readily appreciated from the following description of illustrative embodiments of the present invention taken in conjunction with the attached drawings, in which.

DETAILED DESCRIPTION

Figure 1:
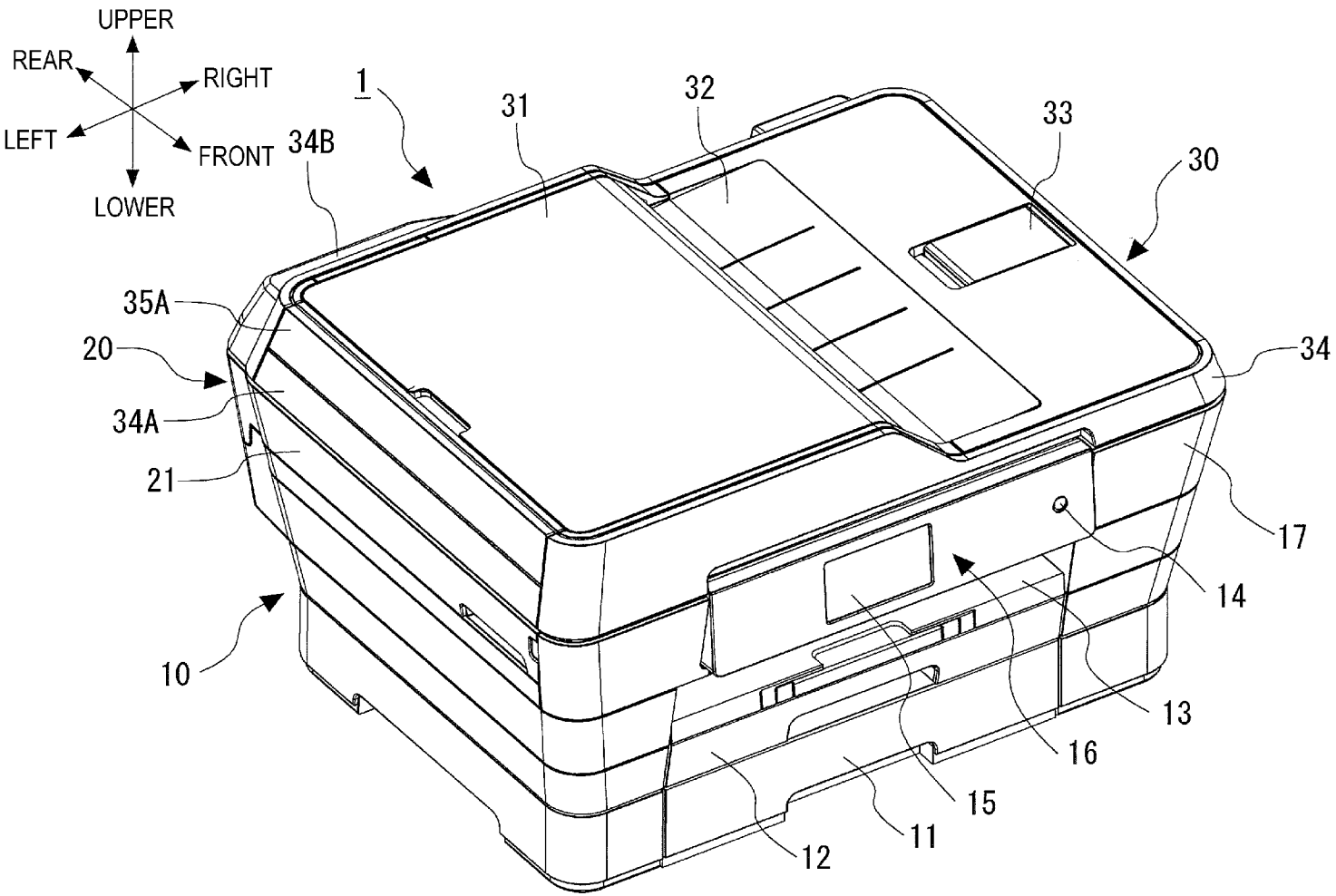
FIG. 1 is a perspective view of a multifunction printer mounted with a sheet transport device according to an illustrative embodiment of the present invention.

Hereinafter, a sheet transport device according to an illustrative embodiment of the present invention, which is applied to a multifunction printer, will be described while referring to the accompanying drawings. The sheet transport device exemplified in the illustrative embodiment is configured as a part of the multifunction printer which has not only an image reading function (scanning function) but also other functions (for example, printing function, copying function, and facsimile transmission/reception function). Also, the illustrative embodiment shown hereinbelow is a preferred specific example of the sheet transport device of the present invention and there are cases in which various technically preferable limitations are given thereto, but the scope of the present invention is not limited to these aspects unless stated to limit the present invention. Further, components of the illustrative embodiment shown hereinbelow can be appropriately replaced by existing components, and various variations, including a combination with other existing components, can be made.

Specifically, there is no limitation in combining the various functions of the multifunction printer with each other and in providing additional functions by using options or the like (for example, a sheet feed cassette). Also, the maximum size (for example, A4 or A3) and the minimum size (for example, postcard size or business card size) of sheets (documents) which is allowed for the sheet transport function can be arbitrarily set. Therefore, the illustrative embodiment shown hereinbelow does not limit the contents of the invention described in the claims. The description hereinbelow will be based on the upper-lower, left-right, and front-rear directions shown in the drawings so as to facilitate the understanding of the relative positional relationship between parts of the multifunction printer. Also, each of the directions is defined on the assumption that the standing position of a user is the front side of the device.

[External Configuration of Multifunction Printer]

Figure 2:
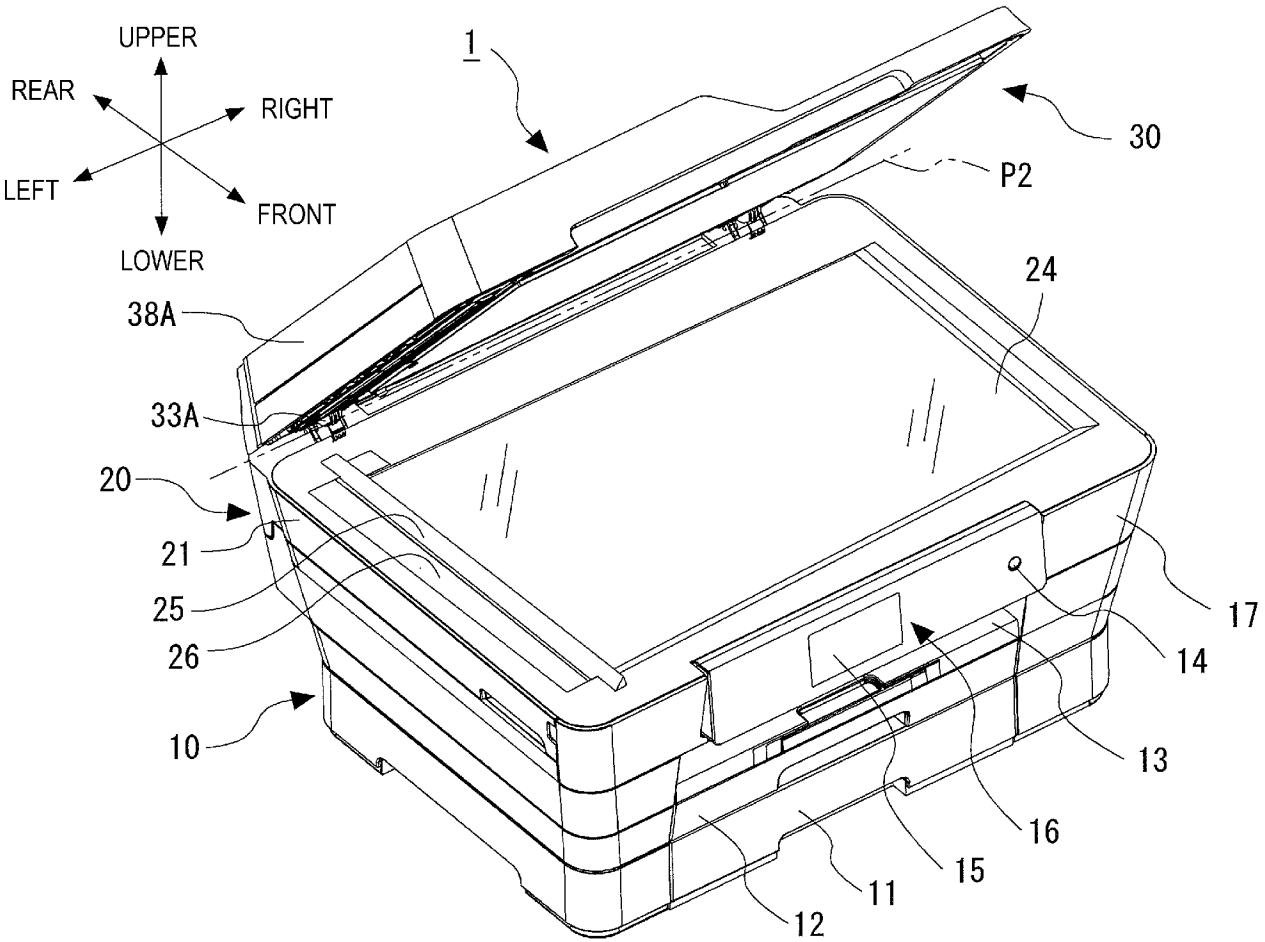
FIG. 2 is a perspective view showing a state where a sheet transport unit of the multifunction printer is opened.

Referring to FIG. 1 and FIG. 2, a multifunction printer 1 includes a main body unit 10, a reading unit 20 which is arranged on an upper part of the main body unit 10, and a sheet transport unit 30 (example of a sheet transport device) which is arranged on an upper part of the reading unit 20. An image forming unit (not shown) is accommodated by the main body unit 10.

[Configuration of Main Body Unit 10]

The main body unit 10 includes drawer-type recording sheet accommodating cassettes 11 and 12 which are arranged in two in the upper-lower direction, and an outlet 13 which is opened at an upper part of the recording sheet accommodating cassettes 11 and 12 and used to discharge recording sheet after an image forming process by the image forming unit. Also, over the outlet 13 and on a front surface side of the main body unit 10, there is provided an operation unit 16 including a switch 14 which is used for a user to input various instructions to the multifunction printer 1, and a touch panel-type liquid crystal display panel 15.

The recording sheet accommodating cassettes 11 and 12 can accommodate recording sheet of different sizes (for example, A4 size and A3 size, and the like). Also, the lower recording sheet accommodating cassette 11 is expandable by an option or the like, and also there is a case in which the lower recording sheet accommodating cassette is not provided. The outlet 13 is an opening which is used to discharge the recording sheet after the image forming process, and, for example, may be a known sheet feed and discharge port which allows the manual feed of postcards and the like. The operation unit 16 may be arranged with, for example, known numeric keys and button-type switches such as mode selection switches for various functional modes (scanning function, printing function, copying function, facsimile transmission and reception function, and the like) of the multifunction printer 1 in combination with the liquid crystal display panel 15. Further, in the illustrative embodiment, the operation unit 16 is arranged on a front cover 17 which is the upper part of the main body unit 10. The front cover 17 is also used as a front cover of the reading unit 20. Therefore, the front cover 17 may be integrally configured with a circumferential wall 21 of the reading unit 20 and the operation unit 16 may be arranged in the reading unit 20.

The main body unit 10 includes driving mechanisms which are necessary to perform the various functional modes of the multifunction printer 1, and a control unit (not shown) which controls the driving mechanism. The control unit controls not only the driving mechanisms arranged in the operation unit 16 and the main body unit 10 but also the various driving mechanisms disposed in the reading unit 20 and the sheet transport unit 30. The driving mechanisms of the reading unit 20 and the sheet transport unit 30 may be subject to another control unit which can be interface-connected with the control unit of the main body unit 10 to ensure the convenience of option installation, unit exchange, and the like.

Within the main body unit 10, a drive motor which drives a recording sheet transport mechanism portion which is used to discharge and transport the recording sheet accommodated in the recording sheet accommodating cassettes 11 and 12 through a sheet feed and discharge path reaching a sheet discharge port 13, the image forming unit which is arranged in the transport path, various sensors which detect the transport timing and jamming of the recording sheet in the sheet feed and discharge path, and the like are arranged to be controlled by the control unit. Known techniques can be employed in the specific configurations and control examples thereof, and thus the description will be omitted herein.

[Configuration of Reading Unit 20]

The reading unit 20 has a structure openable and closable with respect to the main body unit 10, and the pivot center thereof is the axis (not shown) extending in the left-right direction on a rear surface side (rear side shown in FIG. 1) of the main body unit 10 and the reading unit 20.

When the reading unit 20 is displaced to an open position, an upper surface side of the main body unit 10 is opened, and maintenance works can be performed on each part, such as the image forming unit, built into the main body unit 10 although not shown in detail.

The reading unit 20 is surrounded at four sides by the circumferential wall 21, and. As shown in FIG. 2, the reading unit 20 includes a first platen 22 formed of a transparent glass or the like, an abutting member 23 along one edge of the first platen 22, and a second platen 24 formed of transparent glass or the like and arranged on the opposite side from the first platen 22 with respect to the abutting member 23 on an upper surface thereof.

The first platen 22 is used as a supporting surface which supports a still document, and the abutting member 23 is used in the positioning of the document when the user supports the fixed document with the first platen 22. Also, the second platen 24 is used to read the sheets by using the sheet transport unit 30. The first platen 22 has a rectangular shape extending in the front-rear and left-right directions, and the size thereof is larger than the size at which a document having the maximum document size (for example, A3 size) which is readable by the device can be supported. The first platen 22 and the second platen 24 may be integrally formed, and the abutting member 23 may be arranged on upper surfaces thereof by adhesion or the like.

Figure 3:
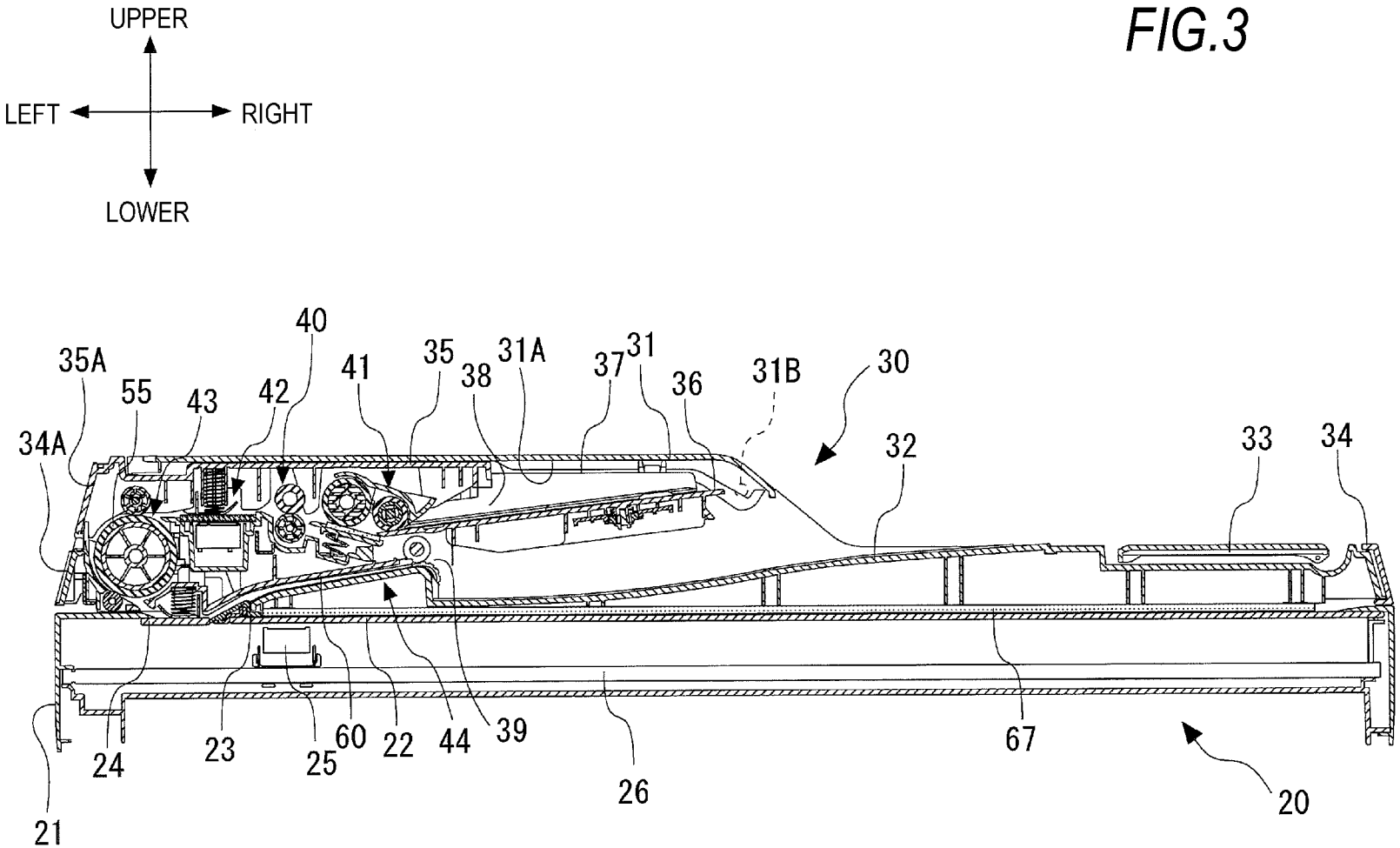
FIG. 3 is a cross-sectional view showing a state where a sheet holding cover of the sheet transport device is closed.
Figure 4:
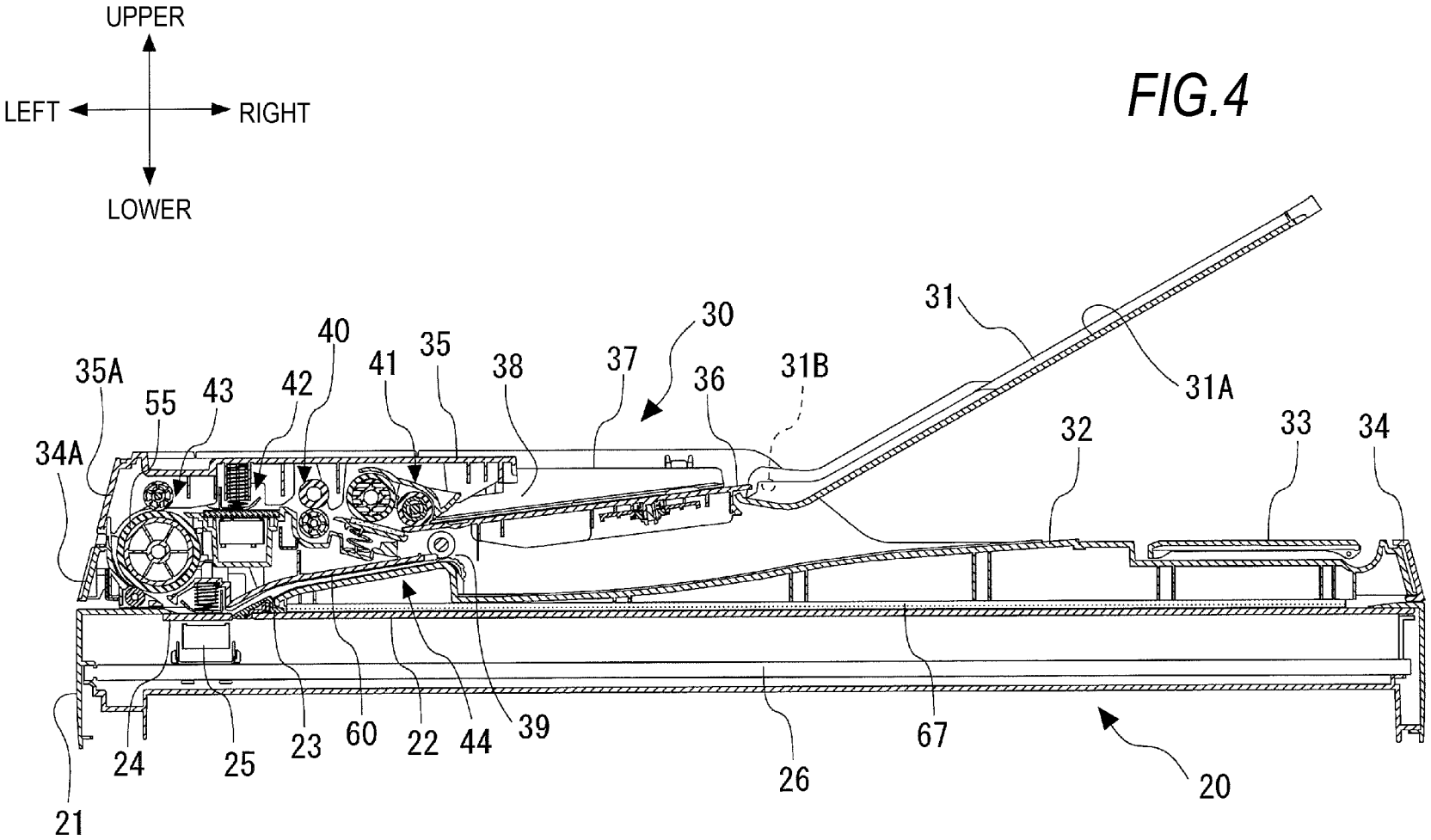
FIG. 4 is a cross-sectional view showing a state where the sheet holding cover of the sheet transport device is opened.

As shown in FIG. 3 and FIG. 4, a movable reading sensor 25 is arranged in a movable manner below the first platen 22 and the second platen 24. The movable reading sensor 25 reciprocates by the driving of a moving motor, which is not shown, along a guide shaft 26 spanning in the left-right direction in an inner space surrounded by the circumferential wall 21 of the reading unit 20. When the image on the sill document is read, the movable reading sensor 25 moves in the left-right direction (sub-scanning direction) within the reading unit 20 along a lower surface side of the first platen 22 as shown in FIG. 3 to read the image on the still document. Also, when the image on the sheet transported by the sheet transport unit 30 is read, the movable reading sensor 25 moves to a position facing the second platen 24 as shown in FIG. 4, and reads the image on the sheet transported by the transport unit 30 at that position. The movable reading sensor 25 reads the image upward while the first platen 22 and the second platen 24 are arranged over the movable reading sensor 25.

[Configuration of Sheet Transport Unit 30]

As shown in FIG. 2, the sheet transport unit 30 has a structure openable and closable with respect to the reading unit 20, and the pivot center thereof is an axis P extending in the left-right direction on a back surface side of the reading unit 20 and the sheet transport unit 30. Therefore, the sheet transport unit 30 can be displaced to a closed position as shown in FIG. 1, that is, a state where the upper surface of the reading unit 20 having the first platen 22 is covered (closed state) and to the open position as shown in FIG. 2, that is, a state where the upper surface of the reading unit 20 having the first platen 22 is exposed (open state). When the sheet transport unit is at the closed position, the sheet transport unit 30 functions as a document cover which covers the first platen 22 and a sheet which is a reading object supported by the first platen 22.

As shown in FIG. 1, the sheet transport unit 30 is arranged with a sheet holding cover 31 to the left from around the center of the upper surface, a sheet discharge tray 32 to the right from around the center of the upper surface, and an extension tray 33 near a right end of the upper surface. The sheet transport unit 30 is surrounded at four sides by the circumferential wall 34, and the circumferential wall 34 is formed by assembling a plurality of divided panels. In the illustrative embodiment, a left side surface portion is further divided vertically into a lower panel portion 34A and an upper panel portion 35A. Also, a driving unit cover portion 34B is mounted on a rear surface of the sheet transport unit 30.

Figure 5:
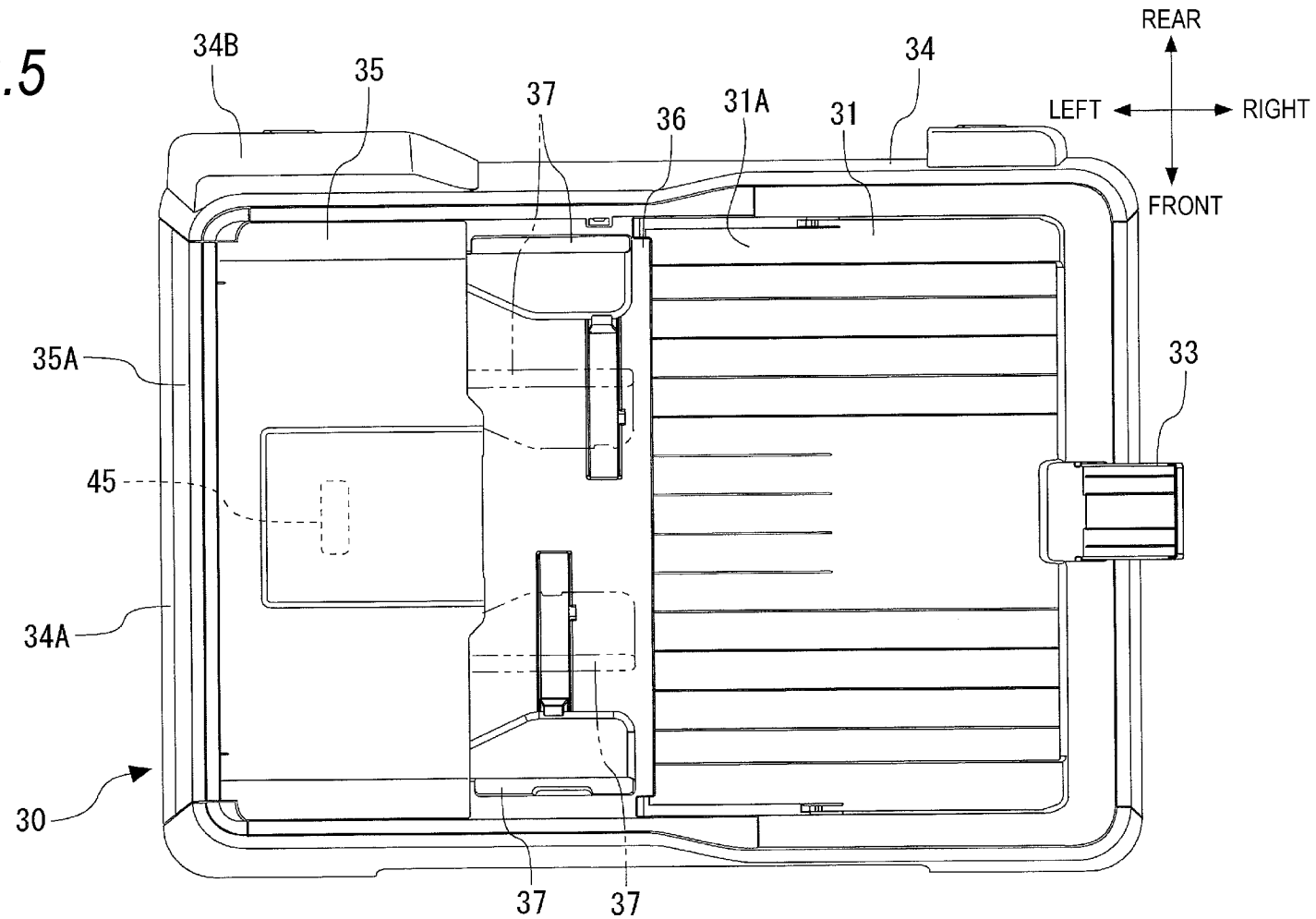
FIG. 5 is a plan view showing a state where the sheet holding cover and an extension tray of the sheet transport device are opened.

The sheet holding cover 31 can be displaced to the closed state shown in FIG. 3 in which a left side from the center in the left-right direction of the sheet transport unit 30 is covered and the open state shown in FIG. 4 and FIG. 5 in which the transport sheet holding surface 31A is exposed. The sheet holding cover 31 is pivotably attached to the sheet transport unit 30 using a pivot shaft 31B which is engaged in the front-rear direction with a cover (not shown) placed inside the circumferential wall 34 near the center in the left-right direction of the sheet transport unit 30 as a fulcrum. When the sheet holding cover 31 is in the opened state, the sheet transport function can be used as an automatic document feeder (ADF). Therefore, when the sheets are held by the transport sheet holding surface 31A, the sheet holding cover 31 is in the opened state with an inclination in which the pivot shaft 31B side is down forward and the free end side is up rearward. Also, when the sheet holding cover 31 is in the opened state, an ADF cover 35 integrally having the upper panel portion 35A and a sheet guide surface 36 are exposed. On the sheet guide surface 36, a pair of sheet guide members 37 which support both side edges along the transport direction of the sheets held by the transport sheet holding surface 31A are arranged. The pair of sheet guide members 37 suppress skew transport by guiding both side edges of the sheets held by the transport sheet holding surface 31A. For example, relative approach and separation can be made between a position corresponding to the width of the maximum allowable size (for example, A3 vertical) set in advance using the main body unit 10 or the sheet transport unit 30 as shown with the solid line in FIG. 5 and a position corresponding to the width of the minimum allowable size (for example, postcard horizontal) shown with the chain line in FIG. 5.

Between the transport sheet holding surface 31A and the ADF cover 35, a sheet feed inlet 38 for the sheet is formed. Between the transport sheet holding surface 31A and the sheet discharge tray 32, a sheet discharge port 39 for the sheet is formed.

Figure 6:
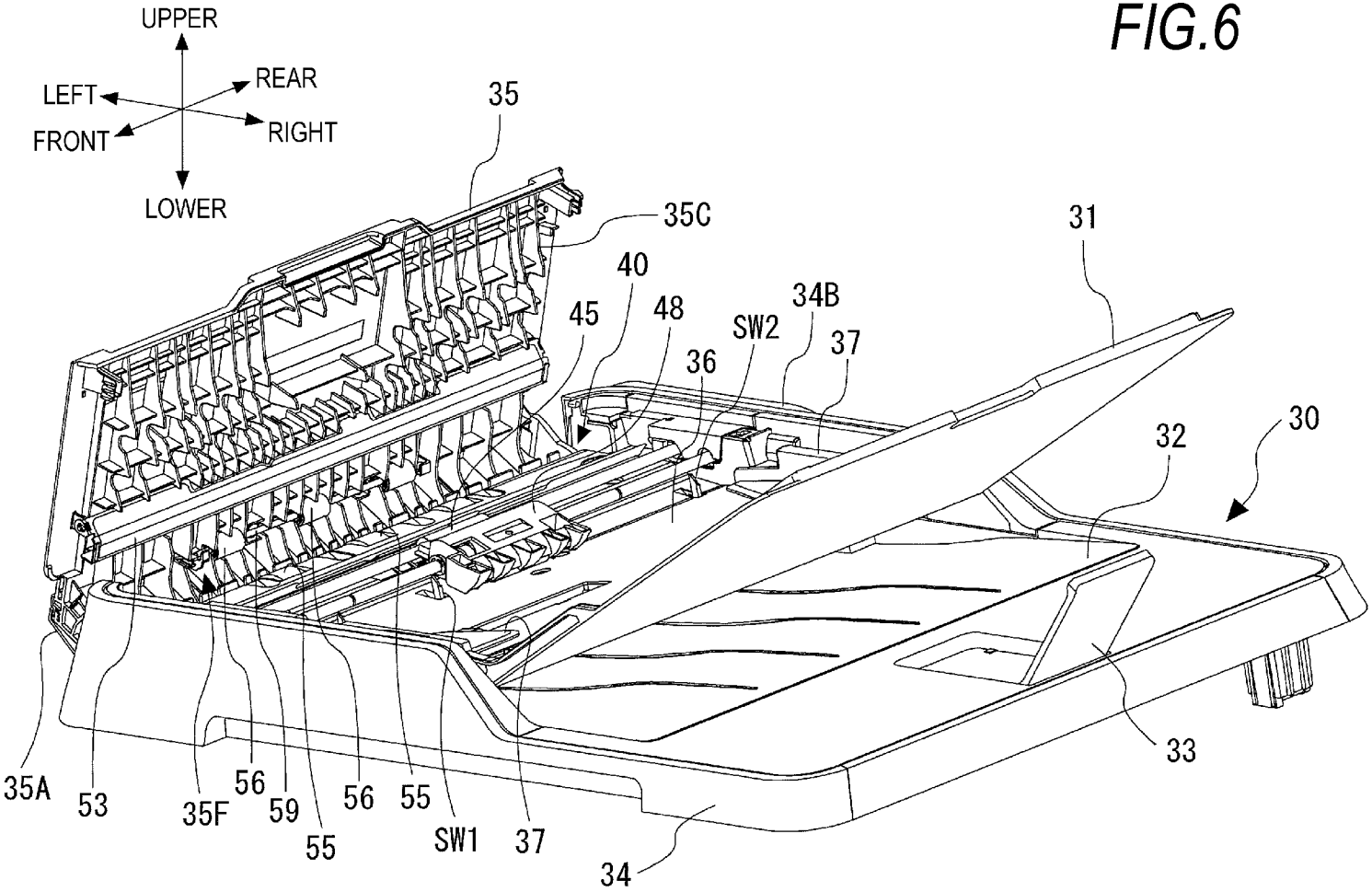
FIG. 6 is a perspective view showing a state where the sheet holding cover, an ADF cover, and the extension tray of the sheet transport device are opened.

In a normal state, the ADF cover 35 covers the sheet transport portion 40 from the sheet feed inlet 38 to the sheet discharge port 39 from above. When maintenance is performed or sheet jamming or the like occurs, the sheet transport portion 40 is opened upward as shown in FIG. 6. The ADF cover 35 may be an attachable and detachable type instead of a pivoting type as long as the sheet transport portion 40 placed therebelow can be opened.

[Overall Configuration of Sheet Transport Portion 40]

Figure 7:
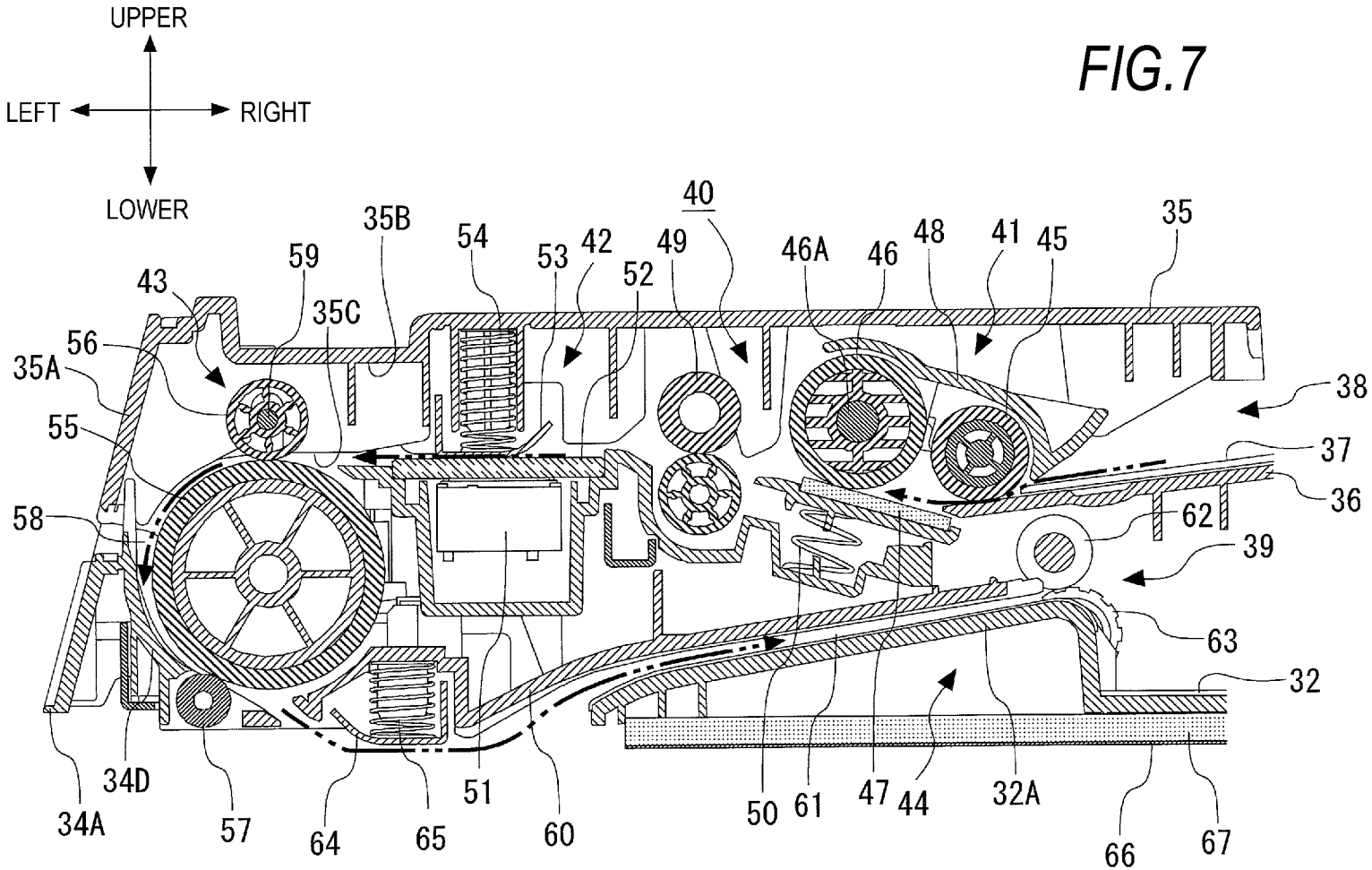
FIG. 7 is a cross-sectional view of a main part of the sheet transport portion of the sheet transport device.

Next, the specific configuration of the sheet transport portion 40 will be described while referring to FIG. 7. In the description below, the sheet transport direction is referred to as a downstream side based on the sheet transport direction (refer to the thick two-dot chain line) and the opposite side is referred to as an upstream side.

The sheet transport portion 40 includes a sheet feed unit 41 which is arranged on the downstream side of the sheet feed inlet 38, a fixed reading unit 42 which is arranged at the downstream side of the sheet feed unit 41, a U-turn transport unit 43 which is arranged at the downstream side of the fixed reading unit 42, and a discharge unit 44 which is arranged at the downstream side of the U-turn transport unit 43 to reach the sheet discharge port 39.

[Configuration of Sheet Feed Unit 41]

The sheet feed unit 41 performs sheet feed toward the downstream side while separating the sheets held in a face-up state by the transport sheet holding surface 31A (sheet guide surface 36) sheet by sheet from the uppermost one. The sheet feed unit 41 includes a sheet feed roller 45, a separation roller 46, a separation pad 47, a swinging holder 48, and a relay roller pair 49.

The sheet feed roller 45 is rotation-driven at a position along the sheet guide surface 36 on the transport direction upstream side of the sheet feed unit 41. The sheet feed roller 45 is rotation-driven in a predetermined direction (clockwise direction in FIG. 7), that is, a direction in which the sheets are drawn to the separation roller 46 by transmitting the driving force of a sheet feed motor (not shown) of a known driving transmission mechanism. In this manner, the sheet feed roller 45 feeds the sheets set on the transport sheet holding surface 31A toward the separation roller 46.

The separation roller 46 is rotatably supported to a frame, which is not shown, at the transport direction downstream side from the sheet feed roller 45. The separation roller 46 is rotated in the same direction as the sheet feed roller 45 by the power transmission caused by the driving of the sheet feed motor.

The separation pad 47 is arranged at a position facing the separation roller 46. The separation pad 47 is biased by a biasing spring 50 toward an outer circumferential surface of the separation roller 46. In this manner, the separation roller 46 operates together with the separation pad 47 and separates only the uppermost sheet in contact with the separation roller 46 from the other sheets to transport the uppermost sheet toward the downstream side.

The swinging holder 48 is supported by a rotating shaft 46A of the separation roller 46 via a bearing, which is not shown. The swinging holder 48 extends from the rotating shaft 46A of the separation roller 46 toward the transport direction upstream side, and rotatably supports the sheet feed roller 45. The swinging holder 48 is swung about the rotating shaft of the separation roller 46 by the power transmission from the sheet feed motor.

At the transport direction downstream side of the sheet feed unit 41, the relay roller pair 49 transports the sheet after the separation toward the fixed reading unit 42. The number of the relay roller pair 49 can be increased or decreased depending on the length of the transport path corresponding to the allowable size set in advance, for example, in the main body unit 10 and the sheet transport unit 30.

[Configuration of Fixed Reading Unit 42]

If necessary, the fixed reading unit 42 reads the image on the sheet that is transported from the sheet feed unit 41. The fixed reading unit 42 is arranged in a portion of the linear-shaped path at the transport direction downstream side than the relay roller pair 49 and at the upstream side than the U-turn transport unit 43. The fixed reading unit 42 includes a fixed reading sensor 51, a third platen 52, a sheet pressing member 53 which faces the fixed reading sensor 51 across the third platen 52, and a biasing spring 54 which biases the sheet pressing member 53 toward the third platen 52.

A contact image sensor (CIS) is used in the fixed reading sensor 51, and the fixed reading sensor 51 is arranged with a reading surface of the image directed upward. The reading range of the fixed reading sensor 51 in a main scanning direction (front-rear direction) is the length corresponding to a short side of the A3 size. Herein, the sheet which is transported by the relay roller pair 49 passes between the third platen 52 which faces the reading surface of the fixed reading sensor 51 and the sheet pressing member 53, and the sheet is transported while being pressed to the third platen 52 side by the sheet pressing member 53. The fixed reading sensor 51 reads the image on a back surface of the passing sheet when the sheet has images on both sides.

[Configuration of U-Turn Transport Unit 43]

The U-turn transport unit 43 includes a main transport roller 55, a pinch roller 56, and a pinch roller 57 so as to form a U-turn transport path 58.

The main transport roller 55 is rotatably supported by a frame, which is not shown, placed inside the lower panel portion 34A, and is rotation-driven by the sheet feed motor or an additional drive motor (not shown). In the illustrative embodiment, the range of approximately one-half to the left of an outer circumferential surface of the main transport roller 55 is used as the U-turn transport path 58. The pinch roller 56 is arranged near an upper end of the main transport roller 55 to be in contact with the main transport roller 55. The pinch roller 57 is arranged to be in contact with the main transport roller 55 from the lower left of the main transport roller 55. Also, at a position which faces the main transport roller 55, a plurality of guide ribs (guide members) 35C which project from an inner surface 35B of the ADF cover 35 toward the main transport roller 55 side and extend in a direction along the transport direction and a guide surface 34D which bends and extends inside from the lower panel portion 34A and is shaped along the outer circumferential surface of the main transport roller 55 are arranged. Therefore, the guide ribs 35C and the guide surface 34D form the U-turn transport path 58 so as to face the main transport roller 55 with a gap. Also, the guide ribs 35C fix a shaft 59 of the pinch roller 56.

[Configuration of Discharge Unit 44]

The discharge unit 44 includes a guide panel 60 which spans in a range reaching the vicinity of the sheet discharge port 39 from a position which faces near a lower end of the main transport roller 55 at the transport direction downstream side than the pinch roller 57, a lower guide panel portion 32A which extends so as to face the guide panel 60 with a gap to form a sheet discharge path 61, a sheet discharge roller 62, and a pinch roller 63 which faces the sheet discharge roller 62. The lower guide panel portion 32A integrally has the sheet discharge tray 32 which is placed at the downstream side.

An upstream end side of the guide panel 60 is arranged with a sheet pressing member 64 which faces an upper surface of the second platen 24, and a biasing spring 65 which biases the sheet pressing member 64 toward the second platen 24. Also, the abutting member 23 (refer to FIG. 2) is placed at a position of the guide panel 60 and specifically, at an upstream end of the downstream side lower guide panel portion 32A. Further, a sheet pad 67 which has a white sheet 66 is attached to a surface of the lower guide panel portion 32A of the sheet discharge tray 32 at an area facing the first platen 22. The sheet pad 67 presses the sheet which is supported by the first platen 22 from above.

[Sheet Transport Operation]

In this configuration, when the sheet is set such that a lower edge of the sheet is directed to the sheet feed inlet 38 while spanning from the transport sheet holding surface 31A to the sheet guide surface 36, the sheet transport portion 40 detects the sheet by using a sheet sensor SW1 (refer to FIG. 6) whose tip end projects from an upper surface of the sheet guide surface 36 at a position close to the swinging holder 48. When the sheet which is set on the transport sheet holding surface 31A is the maximum sheet, the sheet is detected by a maximum sheet sensor SW2 (refer to FIG. 6) whose tip end projects from the upper surface of the sheet guide surface 36 near a rear end of the opposite side to the sheet sensor SW1 across the swinging holder 48. Based on the detection results of the sensors SW1 and SW2, the size of the sheet which is set on the transport sheet holding surface 31 is determined.

When a reading start operation (scanning function or copying function) is made in a state where the sheet sensor SW1 detects the setting of the sheet, the sheets which are set on the transport sheet holding surface 31A are drawn in by the sheet feed roller 45, and the uppermost sheet is separated from the other sheets as the separation roller 46 and the separation pad 47 operate together with each other and is transported toward the relay roller pair 49.

The relay roller pair 49 transports the transported sheet toward the downstream side, and, in a case of a double-sided reading, the image on the back surface side of the sheet is read by the fixed reading sensor 51 when the sheet passes between the third platen 52 and the sheet pressing member 53 during the transport. Also, in a case of a single-sided rearing, the fixed reading sensor 51 does not perform the reading while transporting toward the U-turn transport path 58.

In the U-turn transport path 58, the sheet is transported so as to be U-turned toward the downstream side by the driving of the main transport roller 55 as the pinch roller 56, the guide ribs 35C, the guide surface 34D, and the pinch roller 57 operate together with each other.

When the sheet passes between the sheet pressing member 64 and the second platen 24 through the U-turn transport path 58, the image on a front surface side of the sheet is read by the movable reading sensor 25 at the fixed position. Further, in the discharge unit 44 after the reading of the image, the sheet is discharged from the sheet discharge port 39 toward the sheet discharge tray 32 through the sheet discharge path 61 between the guide panel 60 and the lower guide panel portion 32A by the nip transport by the sheet discharge roller 62 and the pinch roller 63. A height different is formed between the sheet discharge port 39 and the sheet discharge tray 32.

[Configuration of ADF Cover 35]

Figure 8:
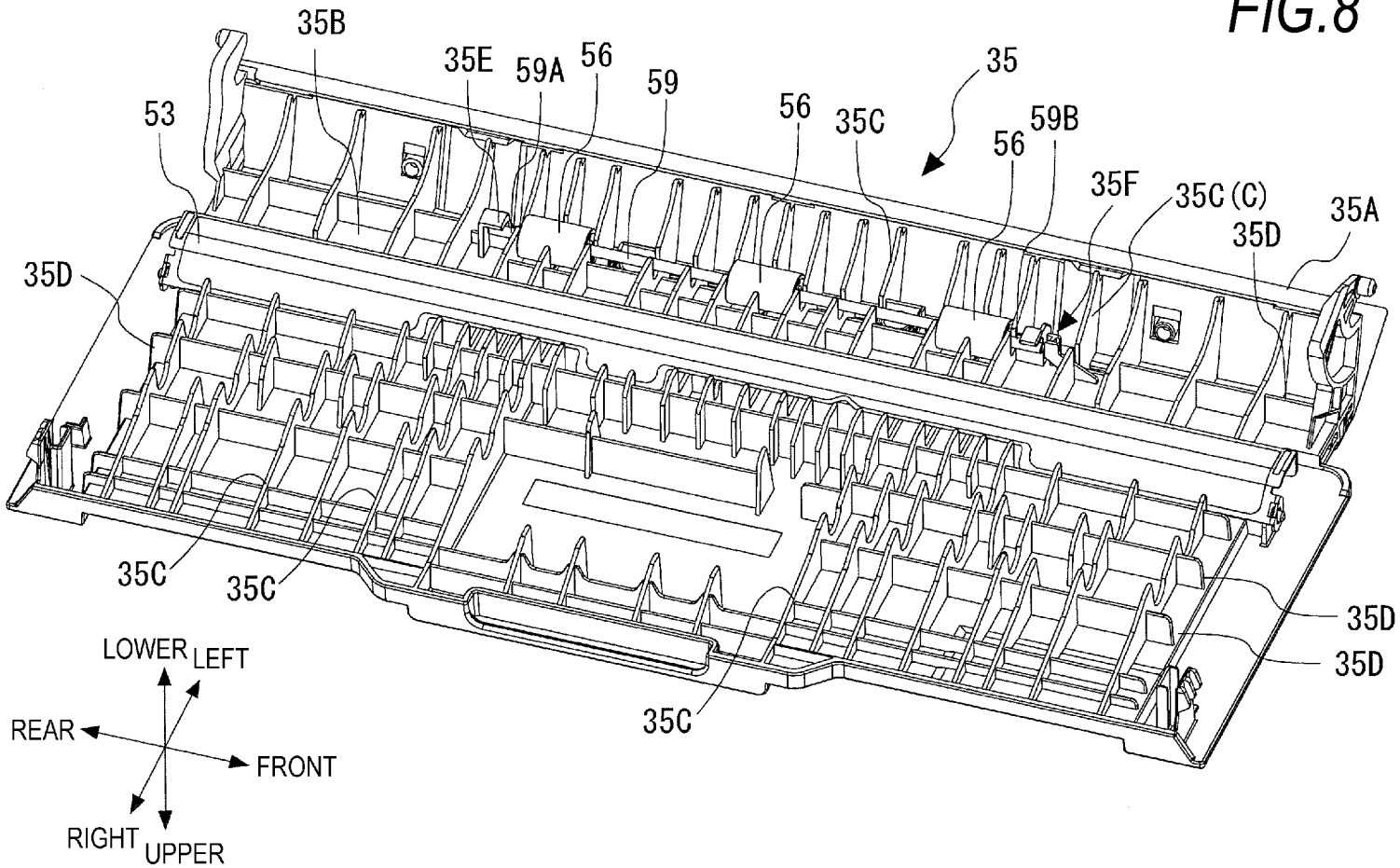
FIG. 8 is a perspective view of a rear surface side of the ADF cover mounted on the sheet transport device.
Figure 9:
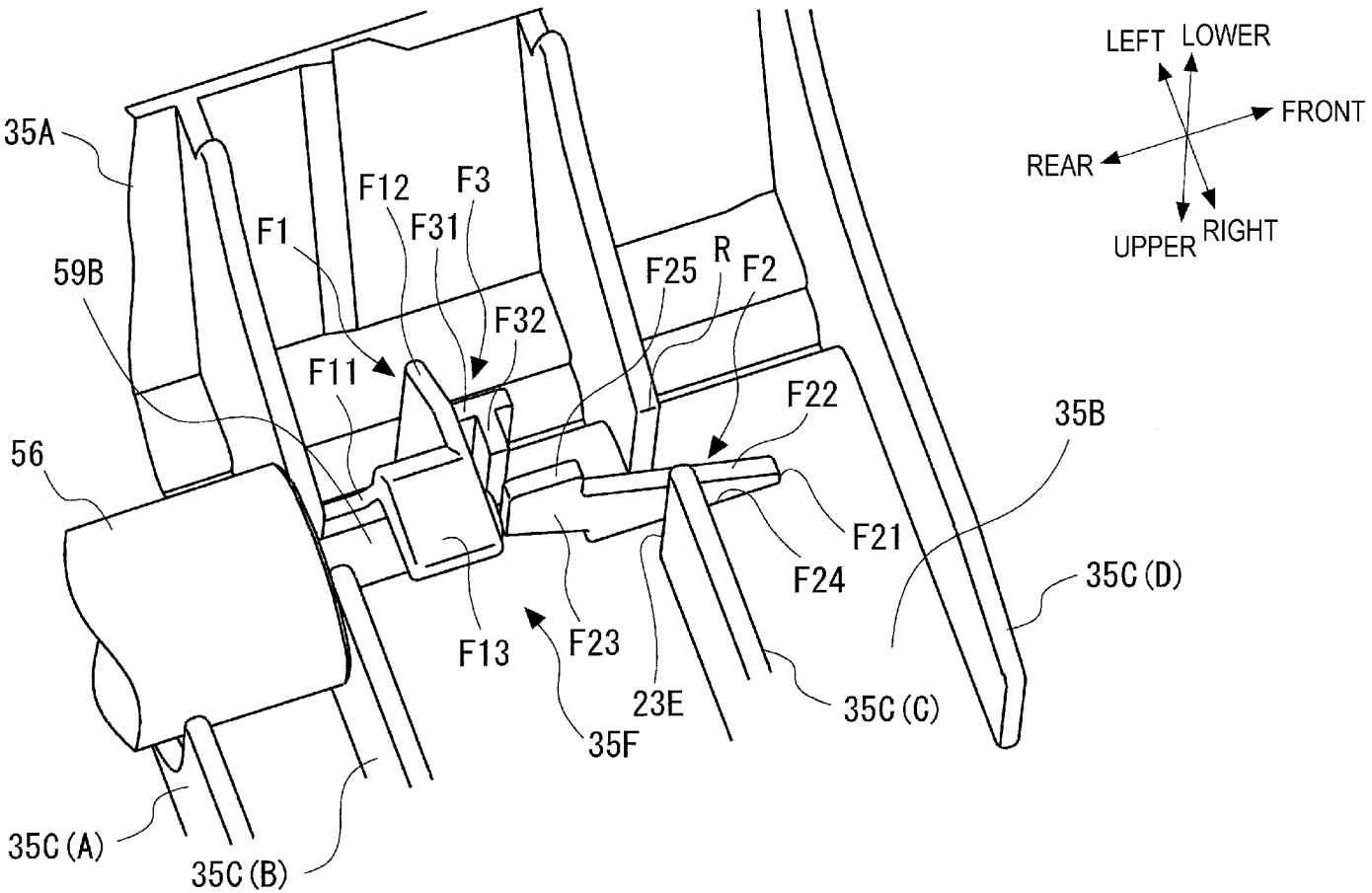
FIG. 9 is a perspective view of a main part of the ADF cover mounted on the sheet transport device.
Figure 10:
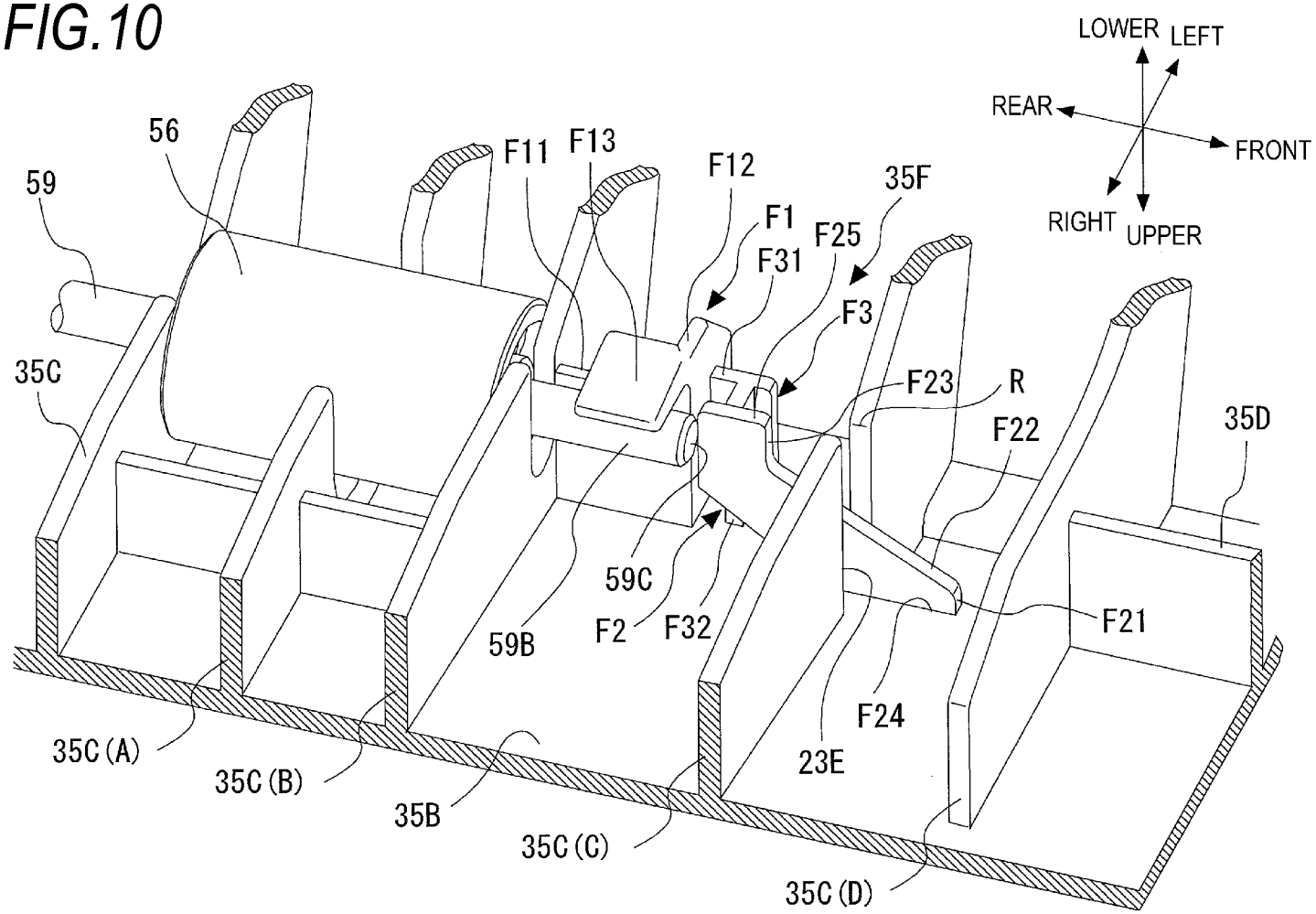
FIG. 10 is a perspective view of the main part of the ADF cover mounted on the sheet transport device.

As described above, the ADF cover 35 is integrally formed with the guide ribs 35C which extend along the sheet transport direction from the inner surface 35B. As shown in FIG. 8, the multiple guide ribs 35C are formed in the front-rear direction crossing the sheet transport direction with a gap. Also, between the guide ribs 35C, multiple reinforcing ribs 35D that extend in a direction orthogonal to the extending direction of the guide ribs 35C are formed. The ADF cover 35 holds the shaft 59 of the pinch roller 56 and the sheet pressing member 53. In the illustrative embodiment, the pinch roller 56 is arranged in a plural number (three positions) in the front-rear direction, and is supported in a rotatable manner by the one shaft 59. It is noted that the number of the pinch rollers 65 is not limited to three positions.

The ADF cover 35 includes a fixed side rib 35E which projects from the inner surface 35B and covers a portion of one end 59A of the shaft 59. By covering a portion facing an end face of the one end 59A of the shaft 59 and an upper section of the one end 59A in the drawing (lower section in the state of use in FIG. 7), the fixed side rib 35E prevents the one end 59A from moving and falling out in the axial direction and toward the upper section in the drawing, respectively. Also, the ADF cover 35 supports the other end 59B of the shaft 59 by a mounting unit 35F which allows attachment and detachment operations.

In the illustrative embodiment, the mounting unit 35F includes a stop portion F1 which stops the other end 59B from falling out downward, a regulation member F2 which regulates the position of the other end 59B along the axial direction, and a stopper portion F3 which regulates the amount of deflection of the regulation member F2 as shown in FIGS. 9 to 12. The guide rib 35C is formed in plural positions as described above, and the extension strength in the direction along the transport direction and the height from the inner surface 35B are different from each other in the portion of formation. Therefore, in the description and drawings hereinbelow, the guide rib 35C in which a portion is recessed to install the pinch roller 56 is referred to as the guide rib 35C (A), the guide rib 35C in which a portion is recessed such that the other end 59B passes is referred to as the guide rib 35C (B), the guide rib 35C at the more front side thereof is referred to as the guide rib 35C (C), and the guide rib 35C at the further front thereof is referred to as the guide rib 35C (D).

The stop portion F1 is integrally formed with the inner surface 35B, and includes a first stop portion F11, a second stop portion F12, and a third stop portion F13 formed integrally with each other. The first stop portion F11 has a surface facing the other end 59B from a left side along the extending direction of the shaft 59 from a front surface side of the guide rib 35C (B). The first stop portion F11 regulates the movement of the other end 59B of the shaft 59 in the left direction. The second stop portion F12 is formed in a shape which is curved from the first stop portion F11 toward the upper panel portion 35A. The third stop portion F13 is continuous from a portion of each of the stop portions F11 and F12, and faces the other end 59B of the shaft 59 from below. The third stop portion F13 regulates a downward movement of the other end 59B of the shaft 59.

The regulation member F2 is a plate-shaped regulation rib which projects from the inner surface 35B toward the main transport roller 55.

Herein, it may be preferable that the regulation member F2 be a plate-shaped regulation rib projecting from the inner surface 35B toward the rotation center Q1 of the main transport roller 55 on an imaginary line L which connects the center Q2 of the shaft 59 of the pinch roller 56 with the rotation center Q1 of the main transport roller 55. The extending direction of the imaginary line L is an example of a first direction. Also, the extending direction of the shaft 59, that is, the extending direction of the center Q2 is an example of a second direction.

In the illustrative embodiment, the pinch roller 56 is arranged so as to be in contact with the top of the main transport roller 55, and thus the regulation member F2 projects in the vertical direction (upper-lower direction) toward the rotation center Q1 of the main transport roller 55 by forming the inner surface 35B facing the pinch roller 56 to be orthogonal to the imaginary line L. Also, the regulation member F2 is a plate-shaped regulation rib which has a surface extending along the extending direction of the shaft 59 and has a thickness in a direction orthogonal to the extending direction of the shaft 59, that is, a direction along the extending direction of the guide rib 35C which is the sheet transport direction.

Figure 12:
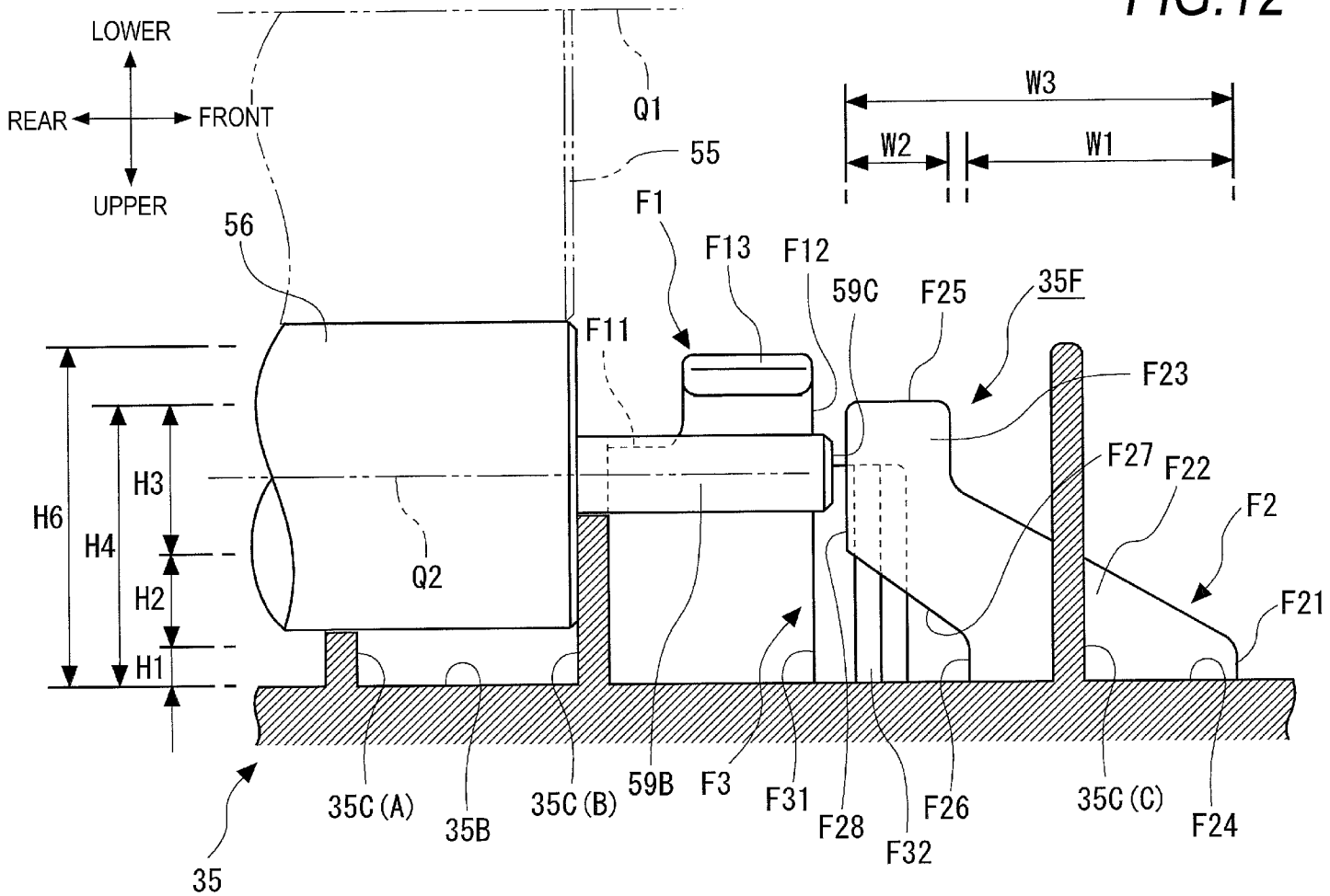
FIG. 12 is a cross-sectional view in a lateral direction of the main part of the ADF cover mounted on the sheet transport device.

As shown in FIG. 12, the regulation member F2 includes the three portions of a base F21 (example of a first surface) which is placed farthest away from an end face 59C of the shaft 59, a middle portion F22 (example of a second surface) which gradually approaches the end face 59C, and a tip end portion F23 (example of a third surface) which approaches closest to the end face 59C. In this manner, the regulation member F2 is shifted in a direction in which a projecting end F25 (example of a second end portion) which is the other side end portion approaches the end face 59C of the shaft 59 with respect to a fixed end F24 (example of a first end portion) with a width W1 which is a connection end connected to the inner surface 35B and extends along the axial direction of the shaft 59, and a curved shape (example of a curved portion) is formed between the fixed end F24 and the projecting end F25. In other words, the projecting end F25 is located closer to the end face 59C of the shaft 59 than the fixed end F24 in the extending direction of the shaft 59.

Focusing on an end edge of the regulation member F2 at the side of the shaft 59, the base F21 has a first end edge F26 which vertically rises from the inner surface 35B so as to be orthogonal to the center Q2 of the shaft 59, the middle portion F22 has a second end edge F27 which is continuous to the first end edge F26 and extends in a diagonal direction so as to approach the end face 59C of the shaft 59, and the tip end portion F23 has a third end edge F28 which is continuous to the second end edge F27 and vertically extends so as to be orthogonal to the center Q2 of the shaft 59. It may be preferable that an end edge of the regulation member F2 which is placed on the opposite side from the shaft 59 have the same direction (parallel) as each of the surfaces F26, F27, and F28 with an extension length allowing for the surface width of the base F21, the middle portion F22, and the tip end portion F24.

When the extension height of the first end edge F26 is H1, the extension height of the second end face F27 is H2, the extension height of the third end edge F28 is H3, and the total height of the regulation F2 is H4 as shown in FIG. 12, it may be preferable that the extension height increase toward the tip end side (H1<H2<H3) so as to facilitate the elastic deformation (hereinafter referred to as 'deflection') in the direction of tilt of the regulation member F2, that is, the left-right direction. Similarly, it may be preferable that the width W2 of the projecting end F25 be narrower than the width W1 of the fixed end F24 (W1>W2), and it may be preferable that the range of W1 and the range of W2 have a positional relationship in which the ranges do not overlap with each other in the upper-lower direction. In other words, it may be preferable that the fixed end F24 and the projecting end F25 be shifted from each other so as not to overlap with each other when viewed from the upper-lower direction. Further, the third end edge F28 of the tip end portion F23 has a linear shape so as to face the end face 59C of the shaft 59 in parallel. The third end edge F28 may have a linear shape in which a portion in contact with the end face 59C of the shaft 59 is along the end face 59C.

Further, for the shape of the ADF cover 35, the regulation member F2 can be formed even though the line L connecting the center Q2 of the shaft 59 with the rotation center Q1 of the main transport roller 55 is not orthogonal to the inner surface 35B in the inner surface 35B. Also, the regulation member F2 can ensure the functions even though the direction in which the regulation member projects from the inner surface 35B is shifted from the rotation center Q1 of the main transport roller 55 and the center Q2 of the shaft 59 if the regulation member is a plate-shaped regulation rib which has no curve or the like in the facing direction to the end face 59C with respect to the movement along the axial direction of the shaft 59.

Figure 11:
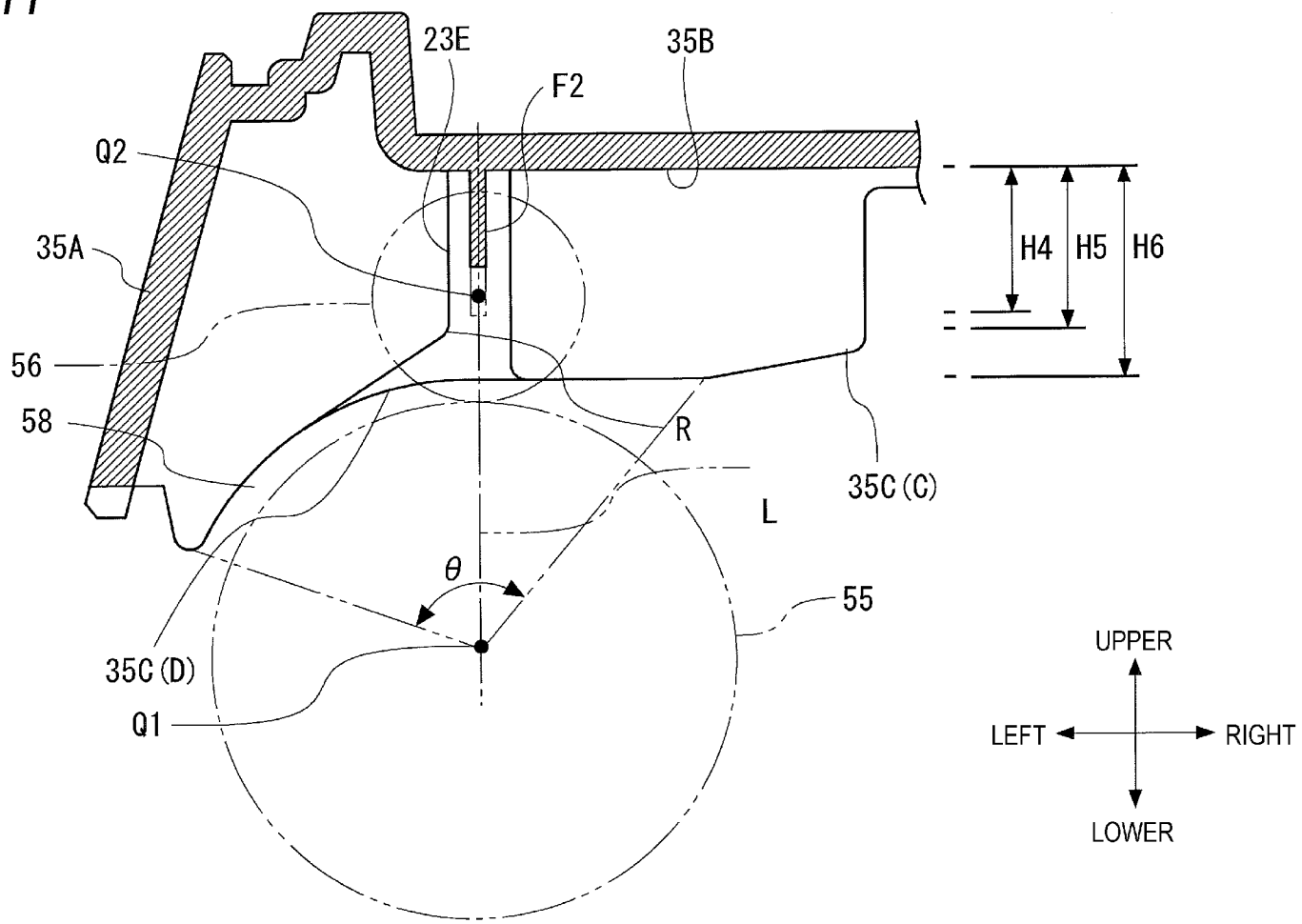
FIG. 11 is a cross-sectional view in the front direction of the main part of the ADF cover mounted on the sheet transport device.

Also, the base F21 extends such that the fixed end F24 spans orthogonally to the guide rib 35C (C) closest to the end face 59C of the shaft 59. At this time, a cutout-shaped slit 23E is formed using a mold structure in the guide rib 35C (C) not integrally with the base F21 to ensure the large total width W3. At this time, as shown in FIG. 11, in the guide rib 35C (C), an angular portion R formed by an edge portion (end face) extending along the extending direction, that is, the sheet transport direction and an edge portion (end face) which forms the slit 23E is chamfered. In other words, the guide rib 35C has a chamfered portion at the angular portion R. Also, the total height H4 of the regulation member F2 is formed to be lower than the height H5 from the inner surface 35B to the angular portion R. Also, the height H5 of the guide rib 23C (C) to the angular portion R is formed to be lower than the height H6 of the guide rib 35C (C) from the inner surface 35B at the upstream side than the slit 23E, that is, lower than the height from the inner surface 35B of the other guide ribs 35C (A), 35C (B), and 35C (D) which do not form the slit 23E.

The stopper portion F3 integrally includes a first stopper F31 which extends along the axial direction of the shaft 59 from the second stop portion F12 of the stop portion F1, and a second stopper F32 which projects toward the regulation member F2 from the first stopper F31. A tip end of the second stopper F32 has a predetermined gap from the regulation member F2.

In this configuration, the one end 59A of the shaft 59 which holds the pinch roller 56 in a rotatable manner is first engaged with and inserted into the fixed side rib 35E, and then the other end 59B is engaged with the stop portion F1. Both of the ends 59A and 59B are not required to be in contact with the fixed side rib 35E and the stop portion F1.

When the other end 59B is engaged with the stop portion F1, the projecting end F25 of the regulation member F2 is fully deflected toward the stopper portion F3, and the tip end portion F23 is retracted from on the axis of the shaft 59. In this manner, the other end 59B of the shaft 59 can be easily engaged with the stop portion F1. The width W1 of the fixed end F24 is narrower than the total width W3 while the total width W3 of the regulation member F2 in the direction along the axial direction of the shaft 59 is ensured to be wide, and thus the deflection in the direction of tilt of the tip end portion F23 can be easily ensured. In other words, the projecting end F25 has a shape extending in the direction approaching the end face 59C of the shaft 59 from the fixed end F24 of the regulation member F2, and thus the length with which the deflection can be made can be ensured to be longer with respect to the height of the regulation member F2.

The shape of the regulation member F2 is not limited to the above description. If the projecting end F25 is shifted to the side of the end face 59C with respect to the fixed end F24, the third end face F28 can be shifted with respect to the end portion of the shaft 59 of the fixed end F24, and the ease of the deflection can be ensured even though the height of the regulation member F2 is formed to be lower than in the related-art technique. Also, the middle portion F22 may be integrated with the base F21 or the tip end portion F23 in appearance.

Figure 13A:
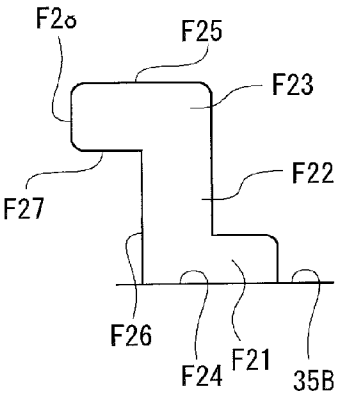
FIGS. 13A to 13F are explanatory views showing modified examples of the shapes of ribs of a regulation member formed in the ADF cover mounted on the sheet transport device.

For example, as shown in FIG. 13A, the base F21 and the middle portion F22 may have the first end edge F26 which vertically rises from the inner surface 35B so as to be orthogonal to the center Q2 of the shaft 59, and the tip end portion F23 may have the second end edge F27 which is continuous to the first end edge F26 and extends in parallel with the center Q2 so as to approach the end face 59C of the shaft 59 and the third end edge F28 which is continuous to the second end edge F27 and vertically extends so as to be orthogonal to the center Q2 of the shaft 59.

Figure 13B:
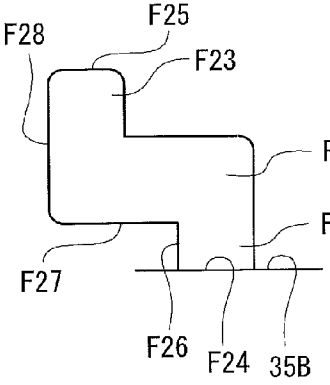

Also, as shown in FIG. 13B, the base F21 may have the first end edge F26 which vertically rises from the inner surface 35B so as to be orthogonal to the center Q2 of the shaft 59, the middle portion F22 may have the second end edge F27 which is continuous to the first end face F26 and extends in parallel with the center Q2 so as to approach the end face 59C of the shaft 59, and the tip end portion F23 may have the third end edge F28 which is continuous to the second end face F27 and vertically extends so as to be orthogonal to the center Q2 of the shaft 59.

Figure 13C:
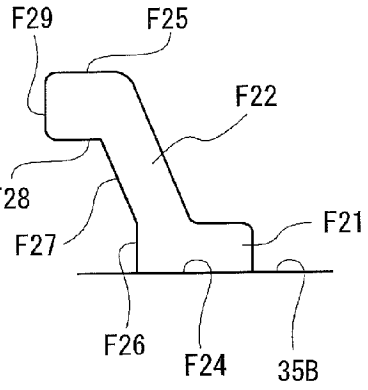

Also, as shown in FIG. 13C, the base F21 may have the first end edge F26 which vertically rises from the inner surface 35B so as to be orthogonal to the center Q2 of the shaft 59, the middle portion F22 may have the second end edge F27 which is continuous to the first end face F26 and extends in the diagonal direction so as to approach the end face 59C of the shaft 59, and the tip end portion F23 may have the third end edge F28 which is continuous to the first end edge F26 and extends in parallel with the center Q2 so as to approach the end face 59C of the shaft 59 and a fourth end edge F29 which is continuous to the third end edge F28 and vertically extends so as to be orthogonal to the center Q2 of the shaft 59.

Figure 13D:
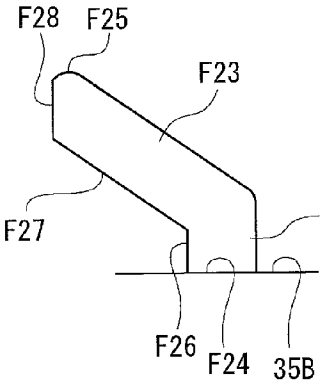

Also, as shown in FIG. 13D, the base F21 may have the first end edge F26 which vertically rises from the inner surface 35B so as to be orthogonal to the center Q2 of the shaft 59, and the tip end portion F23 may have the second end edge F27 which is continuous to the first end face F26 and extends in the diagonal direction so as to approach the end face 59C of the shaft 59, and the third end edge F28 which is continuous to the second end face F27 and vertically extends so as to be orthogonal to the center Q2 of the shaft 59.

Figure 13E:
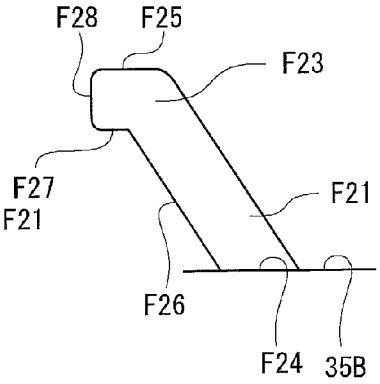

Also, as shown in FIG. 13E, the base F21 may have the first end edge F26 which rises in the diagonal direction from the inner surface 35B so as to approach the end face 59C, and the tip end portion F23 may have the second end edge F27 which is continuous to the first end face F26 and extends in parallel with the center Q2 so as to approach the end face 59C of the shaft 59 and the third end edge F28 which is continuous to the second end edge F27 and vertically extends so as to be orthogonal to the center Q2 of the shaft 59.

Figure 13F:
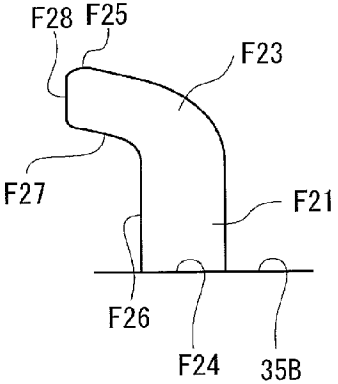

Also, as shown in FIG. 13F, the base F21 may have the first end edge F26 which vertically rises from the inner surface 35B so as to be orthogonal to the center Q2 of the shaft 59, and the tip end portion F23 may have the second end edge F27 which is continuous to the first end edge F26 and is curved and extends obliquely so as to approach the end face 59C of the shaft 59, and the third end edge F28 which is continuous to the second end edge F27 and vertically extends so as to be orthogonal to the center Q2 of the shaft 59.

The regulation member F2 has a surface with a predetermined width in the extending direction of the shaft 59 from each of the first end edge, the second end edge, and the third end edge.

As described above, the sheet transport unit 30 according to the illustrative embodiment of the present invention includes the main transport roller 55 which transports a sheet, the ADF cover 35 which covers the main transport roller 55, the pinch roller 56 which is attached to the ADF cover 35 via the shaft 59 to face the main transport roller 55 to transport the sheet, and the regulation member F2 provided to face the end face 59C of the shaft 59 to regulate the movement of the shaft 59 in the direction along the extending direction. The regulation member F2 is the regulation rib which projects in the first direction from the surface of the ADF cover 35 facing the main transport roller 55 toward the main transport roller 55 and has the surface along the second direction which is the extending direction of the shaft 59. The regulation member F2 includes the fixed end F24 which is fixed to the facing surface, and the projecting end F25 which is the end portion at an opposite side to the fixed end F24 and faces the end face 59C of the shaft 59. The projecting end F25 is shifted with respect the fixed end F24 in the direction approaching the shaft 59 along the second direction.

That is, the regulation member F2 is formed in a non-linear shape in which the projecting end F25 is shifted with respect to the fixed end F24 in the direction approaching the end face 59C of the shaft 59 of the pinch roller 56. Therefore, even in the case of the regulation member F2 which has a predetermined height in the first direction, the length from the fixed end F24 to the projecting end F25 can be ensured to be longer compared to the regulation member F2 extending in a linear shape in the first direction, and the amount of deflection in the direction of tilt of the regulation member F2 can be easily ensured. Therefore, when the pinch roller 56 is attached to the ADF cover 35, the regulation member F2 can be deflected in the direction of tilt, so that the shaft 59 of the pinch roller 56 can be easily held by the ADF cover 35. After the attachment of the shaft 59, the movement of the shaft 59 of the pinch roller 56 in the extending direction with respect to the ADF cover 35 can be regulated by the projecting end F25 of the regulation member F2. Therefore, even when the ADF cover 35 is made thin and the height of the regulation member F2 is smaller than in the related-art technique, the shaft 59 of the pinch roller 56 can be easily attached to the ADF cover 35. Also, the movement of the shaft 59 of the pinch roller 56 can be regulated.

Also, the regulation member F2 has an inclined or curved portion between the fixed end F24 and the projecting end F25, and thus the width of the regulation member F2 can be ensured to be large while the regulation member F2 can be formed in an easily deflected shape.

Further, the surface of the regulation member F2 includes the base F21 which projects in the first direction from the fixed end F24, the middle portion F22 which is continuous to the base F21 and is inclined or curved in the second direction, and the tip end portion F23 which is continuous to the middle portion F22 and projects in the direction along the end face 59C of the shaft 59, and thus the length of the regulation member F2 can be ensured by the middle portion F22. Therefore, even when the regulation member F2 has a limited height, the deflection in the direction of tilt is facilitated during the attachment of the shaft 59, and the regulation member F2 can have the shape in which the functions of the regulation member F2 is reliably achieved after the attachment of the shaft 59.

Also, the part of the projecting end F25 of the regulation member F2 facing the end face 59C of the shaft 59 has a linear shape along the end face 59C of the shaft 59, and thus the projecting end F25 of the regulation member F2 can be accurately brought into contact with the end face 59C of the shaft 59, and the regulation member F2 can reliably achieve the functions.

Also, the inner surface 35B of the ADF cover 35 which faces the main transport roller 55 includes the plurality of guide ribs 35C extending along the sheet transport direction, and the guide rib 35C (C) closest to the end face 59C of the shaft 59 among the plurality of guide ribs 35C is formed with a cutout portion, and the regulation member F2 extends in the direction intersecting the extending direction of the closest guide rib 35C (C) in the cutout portion, and thus the total width W3 of the regulation member F2 can be arranged to be wider while the gap between the plurality of guide ribs 35C (C) is maintained, and a decrease in the accuracy of the transport can be prevented by the guide ribs 35C.

Also, in the closest guide rib 35C, the angular portion R formed by the edge portion extending in the extending direction of the closest guide rib 35C and the edge portion of the slit 23E is chamfered, and thus the hanging of the sheet which is in transport onto the angular portion R of the guide rib 35C can be prevented by the slit 23E.

Also, the height H4 in the projecting direction of the regulation member F2 is formed to be lower than the height H6 in the projecting direction of the rib 35C, and thus the blocking by the regulation member F2 of the transport of the sheet by the guide rib 35C can be suppressed.

Further, the regulation member F2 is integrally formed with the ADF cover 35, and thus the fixed end F24 of the regulation member F2 can be solid and the shape in which the deflection in the direction of tilt of the projecting end F25 side can be properly ensured can be easily formed.

What is claimed is:

1. A sheet transport device comprising:
a transport roller configured to transport a sheet;
a cover configured to cover the transport roller;
a pinch roller attached to the cover via a shaft facing the transport roller, and configured to transport the sheet in cooperation with the transport roller; and
a regulation member projecting from a facing surface, facing the transport roller, of the cover in a first direction which points toward the transport roller, and configured to regulate a movement of the shaft in a direction along an extending direction of the shaft, the regulation member comprising:
a surface which extends along a second direction which is the extending direction of the shaft;
a first end portion which is fixed to the facing surface; and
a second end portion which faces an end face of the shaft, and is located closer to the end face of the shaft than the first end portion in the second direction.

2. The sheet transport device according to claim 1, wherein the regulation member comprises a curved portion having a curved shape between the first end portion and the second end portion.

3. The sheet transport device according to claim 2, wherein the surface of the regulation member comprises:

a first surface which projects from the first end portion in the first direction, a second surface which is continuous to the first surface and is inclined or curved in the second direction, and a third surface which is continuous to the second surface and projects in a direction along the end face of the shaft.

4. The sheet transport device according to claim 1, wherein a part of the second end portion of the regulation member, which faces the end face of the shaft, has a linear shape along the end face of the shaft.

5. The sheet transport device according to claim 1, wherein the cover comprises a plurality of guide members on the facing surface, and the plurality of guide members extend in a sheet transport direction, and wherein a guide member which faces the end face of the shaft and is disposed closest to the end face of the shaft among the plurality of guide members has a cutout portion, and the regulation member extends in a direction intersecting an extending direction of the closest guide member in the cutout portion.

6. The sheet transport device according to claim 5, wherein the closest guide member has a chamfered portion formed between an edge portion extending in the extending direction of the closest guide member and an edge portion of the cutout portion.

7. The sheet transport device according to claim 5, wherein a height of the regulation member in the first direction is lower than a height of the guide members in a projecting direction thereof.

8. The sheet transport device according to claim 1, wherein the regulation member is formed integrally with the cover.

* * * * *